US005823649A

United States Patent [19]

Hinrichs

[11] Patent Number: 5,823,649

[45] Date of Patent: Oct. 20, 1998

[54] DRAWER SLIDE CHILD LOCK

[76] Inventor: Gary M. Hinrichs, 1719 Sunset Dr., St. Charles, Mo. 63301

[21] Appl. No.: 896,776

[22] Filed: Jul. 18, 1997

[51] Int. Cl.[6] ..... A47B 88/00

[52] U.S. Cl. ..... 312/334.45; 312/334.46; 312/334.47

[58] Field of Search ..... 312/333, 334.44, 312/334.45, 334.46, 334.47

[56] References Cited

U.S. PATENT DOCUMENTS

| | | | |
|---|---|---|---|
| 3,937,531 | 2/1976 | Hagen et al. | 308/3.8 |
| 4,065,196 | 12/1977 | Stein | 312/333 |
| 4,139,249 | 2/1979 | Hillman | 312/333 |
| 4,423,914 | 1/1984 | Vander Ley | 312/333 |
| 4,505,526 | 3/1985 | Leck | 312/333 |
| 4,564,248 | 1/1986 | Grass | 308/3.8 |
| 5,203,620 | 4/1993 | McLennan | 312/334.46 |
| 5,215,362 | 6/1993 | Zoellner | 312/334.46 |
| 5,344,226 | 9/1994 | Lee et al. | 312/334.47 |
| 5,445,451 | 8/1995 | Harmony | 312/333 |
| 5,634,703 | 6/1997 | Vonier | 312/334.44 |

*Primary Examiner*—Peter M. Cuomo
*Assistant Examiner*—Gerald A. Anderson
*Attorney, Agent, or Firm*—Bryan Cave LLP

[57] ABSTRACT

A child-proof drawer lock assembly for drawers fitted with or without drawer slide rollers. The lock assembly is movably mounted on the external drawer side of the drawer. A restraining member is mounted to a lever that is accessible when the drawer is partially opened. The restraining member alternatively engages a cabinet-mounted drawer slide roller through a slot in the drawer-mounted drawer slide or engages the interior of the cabinet face. The drawer is unlatched by lifting the pivotally mounted lever a sufficient distance so that the restraining member clears the roller, or the cabinet face, while the drawer is conventionally opened. The assembly can also be disengaged to allow for conventional operation of the drawer.

12 Claims, 7 Drawing Sheets

DRAWER SLIDE CHILD LOCK

FIELD OF INVENTION

This invention relates to drawer latches and, more particularly, to latches designed to prevent easy access to drawers by small children.

BACKGROUND OF THE INVENTION

Latches are known which enable a drawer to be partially opened and which then require further manipulation to fully open the drawer. Conventionally, such a latch prevents toddlers and small children from gaining access to potentially dangerous items stored in the drawers. These latches are designed with the assumption that young children lack the mental and/or physical ability to simultaneously manipulate the latch to a disengaged position and open the drawer.

A disadvantage of commercially available latches of this type is that they must be purchased and retrofitted to the cabinet by the user. Installation of conventional latches can be difficult and inconvenient, depending on the size and location of the drawer, the type of latch and the skill of the installer. Accordingly, many potential users of such latches fail to take advantage of a much needed safety device.

The most common child-proof latches available have an arm that is installed on the inside surface of the front panel of a drawer. This arm must be manually depressed to disengage it from an interlocking member on the cabinet frame. Examples of such latches are described in Hillman U.S. Pat. No. 4,139,249, Leck U.S. Pat. No. 4,505,526, and Harmony U.S. Pat. No. 5,445,451. In addition to the inconvenience and difficulty of installing such latches there are several other disadvantages of latches of this type. For example, once the latch is installed, desired normal operation of the drawer is no longer possible, even for short periods of time, such as when children are sleeping or away from home, unless the latch is physically removed. Additionally, the required placement of the latch interferes with and limits a portion of the useable drawer space, thereby hindering full use of drawer. Furthermore, the latch is clearly visible to children when a drawer is partially opened to an engaged position. This invites a child's curiosity, which typically leads to an earlier discovery of how to overcome the latch. Moreover, the downward motion required to open the latch is a skill easily acquired by children, especially when facilitated by their body weight. Thus, the latch tends to lose its effectiveness on children at an earlier age than is desirable.

Accordingly, there is a continuing need for a low cost child-proof latch that may be included as part of the original drawer slide hardware, thereby eliminating the need to retrofit such a device and providing all new cabinet purchasers with a built-in child-proof latch option. Such a latch could also be retrofitted onto existing drawers. Preferably, such a latch would easily disengage to permit conventional operation of the drawer when such operation is desirable, and then easily re-engage when the child-proof feature is desired. The preferred latch would not interfere with any of the useable drawer space. Preferably, the latch would be installed such that it is largely hidden from view, thereby keeping children ignorant as to the existence and the means of overcoming the latch. Furthermore, the latch would minimize even partial access to a drawer by children. Moreover, the preferred latch would maintain its effectiveness for a longer period of time because the action required for a child to manipulate and overcome the latch and open the drawer is more difficult than existing latches.

Additionally, preferably, adults would be able to easily manipulate the latch, allowing the drawer to be opened with minimal effort.

SUMMARY OF THE INVENTION

A preferred child-proof lock assembly for a drawer having these features and satisfying these needs has now been developed.

Preferably, the lock assembly is used with a drawer that is mounted in a cabinet base and has a male drawer slide with a flange attached to the external side of the drawer. A female drawer slide is preferably mounted within the cabinet base and has a female guide channel for slideably receiving the male drawer slide to allow the drawer to guidably slide in and out of the cabinet base. The female drawer slide also preferably has a roller attached to the front end of the slide. The lock assembly includes a latch mounted on the external side of the drawer and is movable between a gravity disposed first position to prevent the drawer from opening and a second position to allow the drawer to be opened. Preferably, the latch has an elongated lever arm pivotally mounted to the external side of the drawer and extends radially and upwardly toward the top and front of the drawer. The latch further includes a restraining member projecting downwardly from the lever arm. Additionally, the male drawer slide includes a slot in its flange through which the restraining member may be received and project below the flange. In operation, the restraining member will engage the roller when the latch is disposed in the first position to prevent the drawer from opening. To open the drawer, the lever arm is raised upon application of upward pressure to move the latch into the second position.

In a preferred embodiment, to ease closing of the drawer, the rear edge of the restraining member is angled so that the restraining member may travel up and over the roller of the female drawer slide without manipulation of the lever arm.

In another embodiment, the lock assembly includes a latch mounted on the external side of the drawer and is movable between a gravity disposed first position to prevent the drawer from opening and a second position to allow the drawer to be opened. Preferably, the latch has an elongated lever arm pivotally mounted to the external side of the drawer and extends radially and upwardly toward the top and front of the drawer. The latch further includes a restraining member projecting downwardly from the lever arm. The latch also includes a mounting base attached to the external side of the drawer capable of engaging the lever arm to prevent downward rotation of the lever arm. In operation, the restraining member will engage the interior side of the cabinet base when the latch is disposed in the first position to prevent the drawer from opening. To open the drawer, the lever arm is raised upon application of upward pressure to move the latch into the second position such that the restraining member may pass over the cabinet base. This embodiment may also provide a means to ease closing of the drawer wherein the rear edge of the restraining member is angled so that the restraining member may travel up and over the cabinet base without manipulation of the lever arm.

BRIEF DESCRIPTION OF THE DRAWINGS

These and other features, aspects, and advantages of the present invention will become better understood with regard to the following description, appended claims, and accompanying drawings wherein:

These drawings are for illustrative purposes only and should not be used to unduly limit the scope of the appended claims.

DETAILED DESCRIPTION OF THE INVENTION

Figure 1:
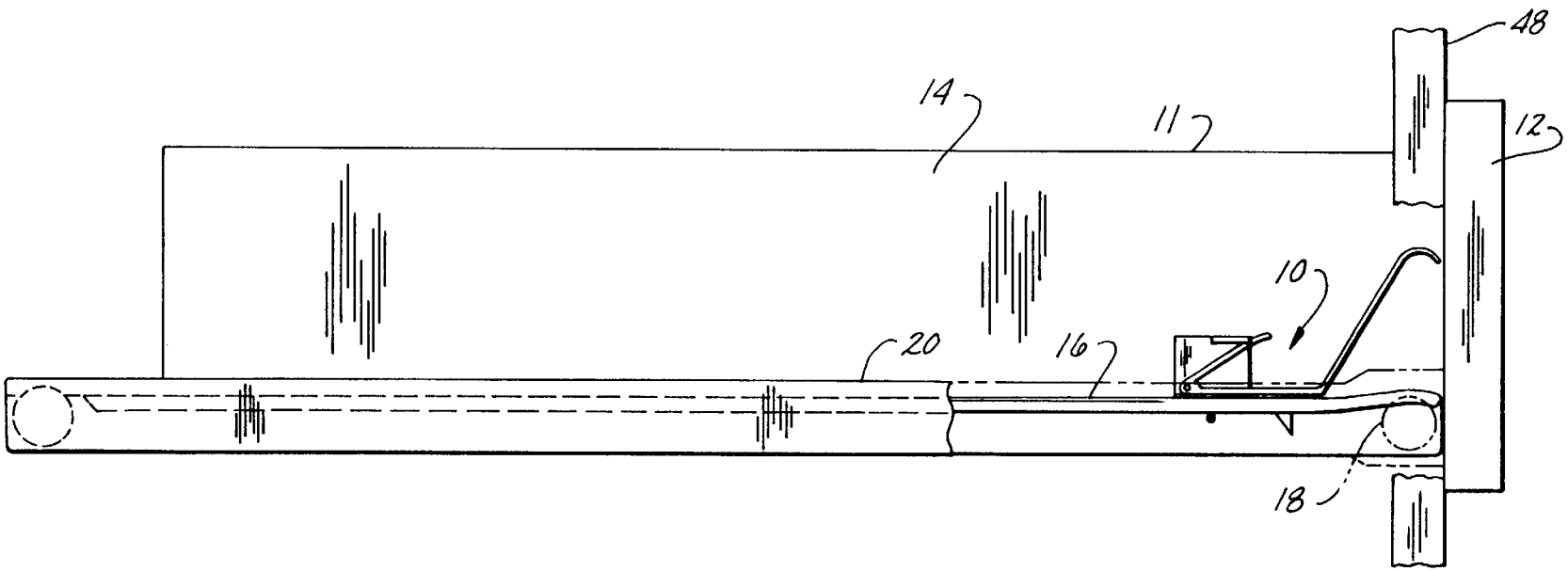
FIG. 1 is a side view of a drawer in the closed position showing drawer slides, with female drawer slide cut away, and one preferred embodiment of the drawer slide child lock assembly.
Figure 2:
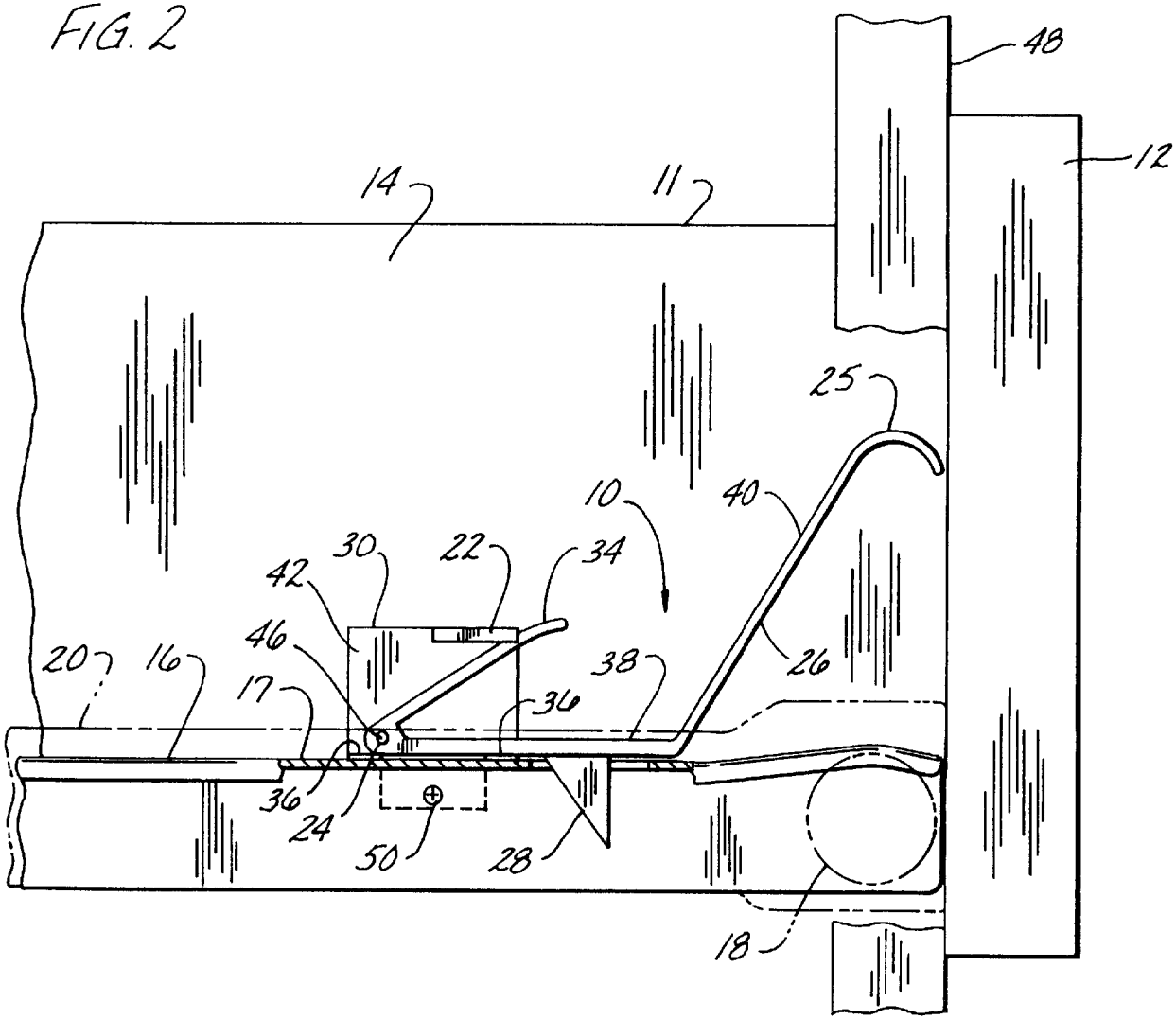
FIG. 2 is a partial close-up of FIG. 1, with male drawer slide cut away, further detailing a preferred embodiment of the drawer slide child lock assembly.
Figure 3:
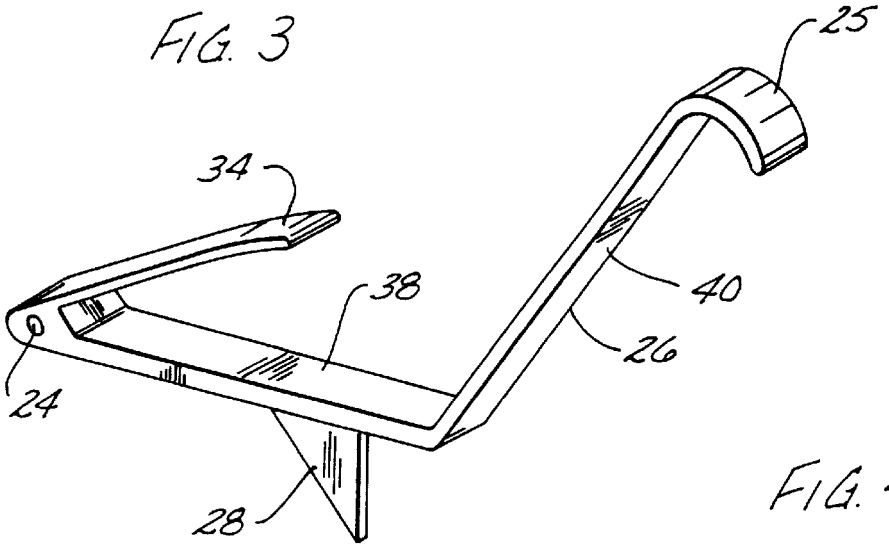
FIG. 3 is an isometric view of the lever arm.
Figure 4:
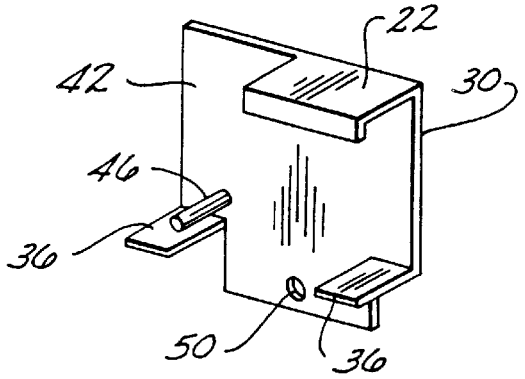
FIG. 4 is an isometric view of the mounting base.

Referring to FIGS. 1 and 2, therein is illustrated a drawer slide child lock assembly 10 which is mounted upon the upper flange 17 of a horizontal male drawer slide 16, which is attached to a drawer side 14. The child lock assembly 10 preferably comprises two separate components, a latch 26 and a mounting base 30 (as shown in FIGS. 3 and 4). The material used to make the assembly 10 is preferably plastic or any other substantially rigid material or combination of materials.

As shown in FIGS. 3 and 4, the latch preferably comprises a one piece lever arm 26 having a horizontal section 38 with a pivot point 24 designed to fit loosely over pin 46, or other pivoting connection, of mounting base 30 so that lever arm 26 is attached to mounting base 30 and can be rotated about pin 46 at pivot point 24. A tail 34 extends upwardly from pivot point 24 at an acute angle to horizontal section 38 of the lever arm 26 and may be compressed to rest against the front side of mounting base flange 22 so that horizontal section 38 is forced to lay flat on top of male drawer slide 16 (see FIG. 2). Preferably, the tail 34 resiliently biases the horizontal section 38 of lever arm 26 to the top of male drawer slide 16.

Preferably, a restraining member such as stop 28 extends downwardly from the horizontal section 38 of the one piece lever arm 26. The stop 28 preferably has an angled rear edge facing the back of the drawer 11 (as shown in FIG. 2) so that, as the drawer 11 is closed, the angled edge of stop 28 easily travels up and over the roller 18 of the female drawer slide 20 without manipulation of the lever arm 26. A neck 40 preferably extends at an obtuse angle from horizontal section 38. A finger lift 25, or the like, preferably extends as a semi-circle from neck 40.

A mounting base 30 is preferably attached to an exterior side of drawer 11 and has a baseplate 42 with a mounting base flange 22 preferably extending perpendicular from the top right corner and horizontal legs 36 extending preferably perpendicular from bottom corners and which may preferably rest upon the flange 17 of male drawer slide 16. A pin 46 extends perpendicular from the left corner of baseplate 42 and a screw hole 50 is positioned preferably in the center of baseplate 42 and below horizontal legs 36.

Figure 5:
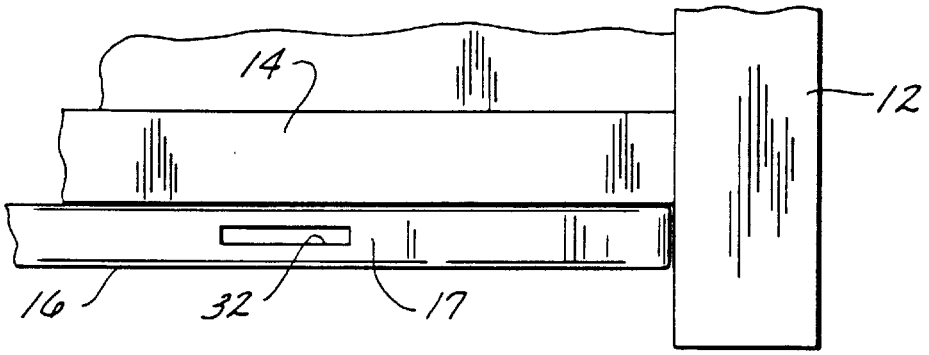
FIG. 5 is a top view of the front corner of a drawer and a male drawer slide with cutout.

Referring to FIG. 5, a slot 32 in the top of male drawer slide flange 17 permits stop 28 to pass through the slot 32 thus allowing the horizontal section 38 of lever arm 26 to engage with and rest flat upon top of male drawer slide 16 (as illustrated in FIG. 2).

Referring again to FIG. 2, therein is illustrated a preferred embodiment of the complete child lock assembly 10, with horizontal legs 36 of mounting base 30 resting on top of male drawer slide 16 and attached to drawer side 14, as it appears in relation to roller 18 of female drawer slide 20 when drawer 11 is in a fully closed position. Preferably, male drawer slide 16 is fastened to the drawer side 14 and moves as one unit with the drawer 11. Female drawer slide 20 is fastened to the cabinet base 48 and is stationary with respect to drawer 11 and male drawer slide 16.

As further illustrated in FIG. 2, the distance between stop 28 of lever arm 26 and roller 18 of female drawer slide 20 represents the distance the drawer front 12 can travel toward the open position before it is stopped by the child lock assembly 10.

Figure 6:
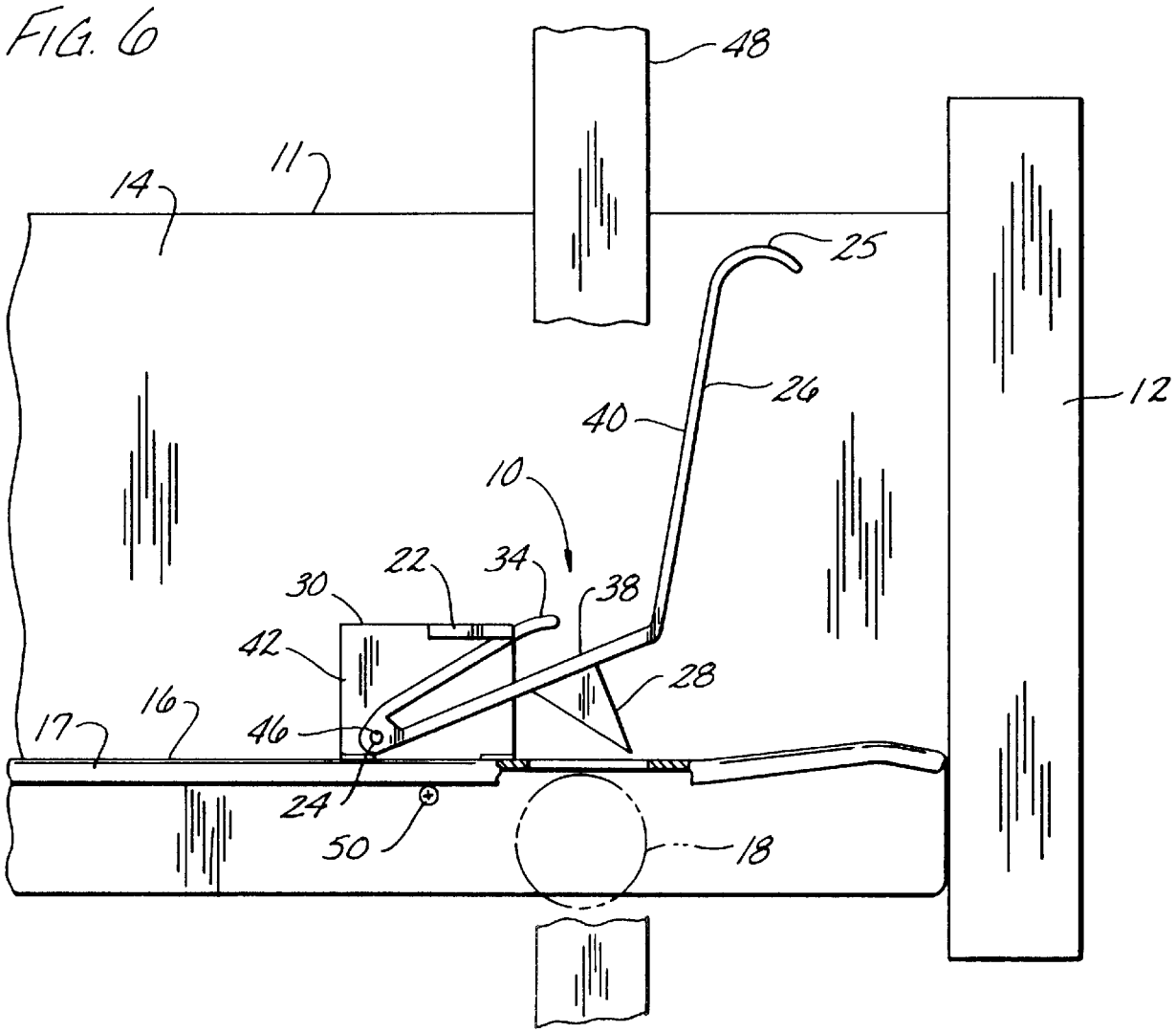
FIG. 6 is a side view of drawer slide child lock assembly with the lever arm manually manipulated to a raised position and the drawer in a partially opened position.

Referring now to FIG. 6, a preferred embodiment of the child lock assembly 10 is illustrated with the lever arm manually manipulated to a raised position necessary for opening the drawer and the drawer is shown in the partially open position. The tail 34 of lever arm 26 is held stationary by the front of mounting base flange 22 and compresses in relation to horizontal section 38 when sufficient upward pressure is applied at finger lift 25 to raise lever arm 26. Lever arm 26 is raised sufficiently to allow stop 28 to disengage and clear the path of roller 18. When manual pressure is removed from finger lift 25 of lever arm 26 the natural resilience of tail 34 creates a spring-like action returning horizontal section 38 of lever arm 26 to a home position flat on top of male drawer slide 16 and placing stop 28 in the pathway of roller 18 (as illustrated in FIG. 2).

Referring jointly to FIG. 2, FIG. 6 and FIGS. 7A–7E, the opening and closing of a drawer 11 fitted with a preferred embodiment of the drawer slide child lock assembly 10 of the present invention will be described.

Figure 7A:
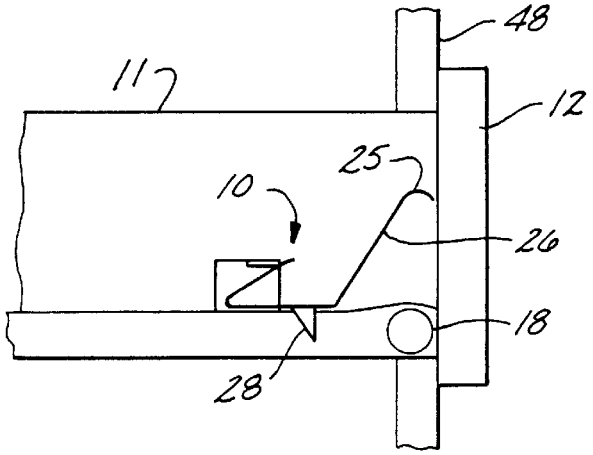
FIGS. 7A–7E are side views illustrating the steps for opening and closing the drawer with the drawer slide child lock engaged.
Figure 7B:
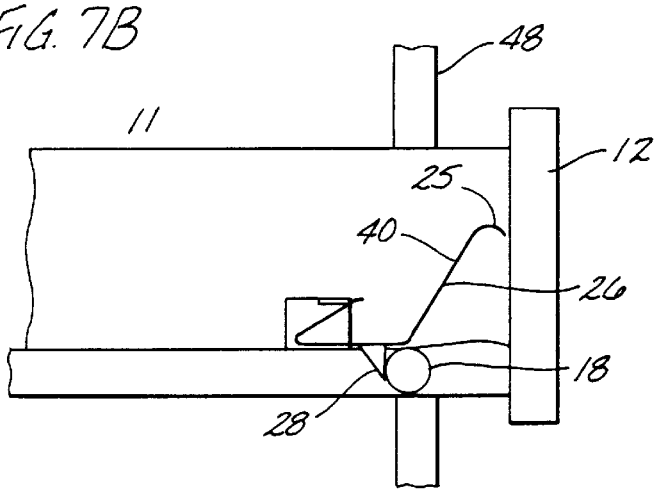

FIG. 7A illustrates a drawer front 12 fully closed and resting against cabinet base 48. To open, drawer front 12 is pulled away from cabinet base 48 in a conventional manner and opens until stop 28 engages roller 18 as illustrated in FIG. 7B. Further opening of the drawer 11 is prevented because the stop 28 cannot move past roller 18 without engaging lever arm 26. Thus the drawer 11 remains sufficiently closed to prevent access to the contents therein. Only neck 40 and finger lift 25 of lever arm 26 are visible when drawer 11 is opened to this limited extent and the plainness of such attracts little attention from toddlers or small children.

Figure 7C:
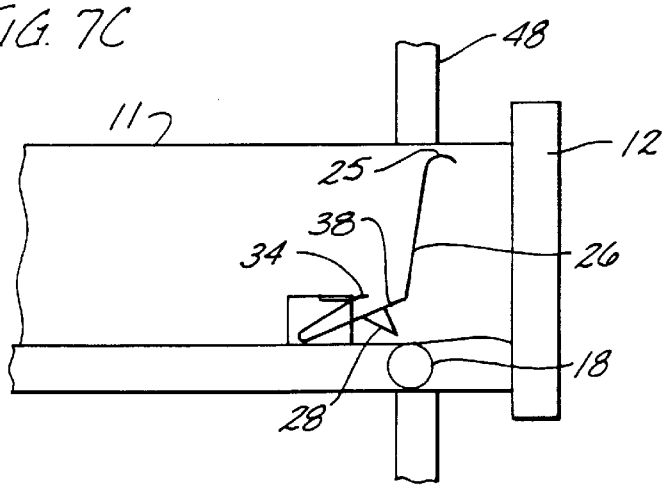
Figure 7D:
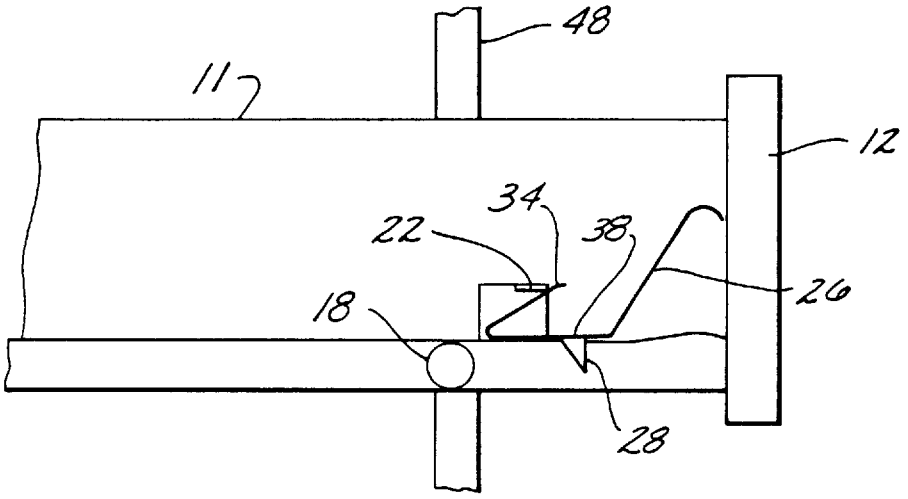

To permit full opening of the drawer 11, lever arm 26 must be sufficiently lifted by raising finger lift 25 and pulling upward with a force that overcomes the natural resilience of tail 34 (see FIG. 6) so that stop 28 is lifted above roller 18 as depicted in FIG. 7C. While lever arm 26 is manually raised, drawer front 12 must be pulled forward a sufficient distance for stop 28 to travel past roller 18 as illustrated in FIG. 7D. Preferably, the downward force on the horizontal section 38 of lever arm 26 created by the natural resilience of tail 34 is such that it is difficult for a small child to overcome. This acts as one deterrent to prevent the child from opening the drawer 11. Preferably, the lifting motion required to raise lever arm 26 naturally creates a momentum toward closing the drawer 11. The lock is effective because small children lack the ability to overcome the downward force created by the natural resilience of tail 34 and lift lever arm 26 sufficiently for stop 28 to clear roller 18, while at the same time overcoming the backward momentum of drawer 11, and pulling drawer front 12 a sufficient distance forward to allow stop 28 to travel past roller 18.

The natural resilience of tail 34 returns lever arm 26 to a home position, so that horizontal section 38 is resting on top of male drawer slide 16 and stop 28 is in the pathway of roller 18 when the finger lift 25 is released as illustrated in FIG. 7D.

Pivot point 24, as illustrated in FIG. 6, allows lever arm 26 to be rotated upward and away from male drawer slide 16. The position of mounting base flange 22 is such that lever arm 26 can be rotated upward sufficiently to allow stop 28 to rise above male drawer slide 16 without horizontal section 38 engaging tail 34. The natural resilience of tail 34 maintains lever arm 26 in the home position when no lifting force is applied at finger lift 25.

Figure 7E:
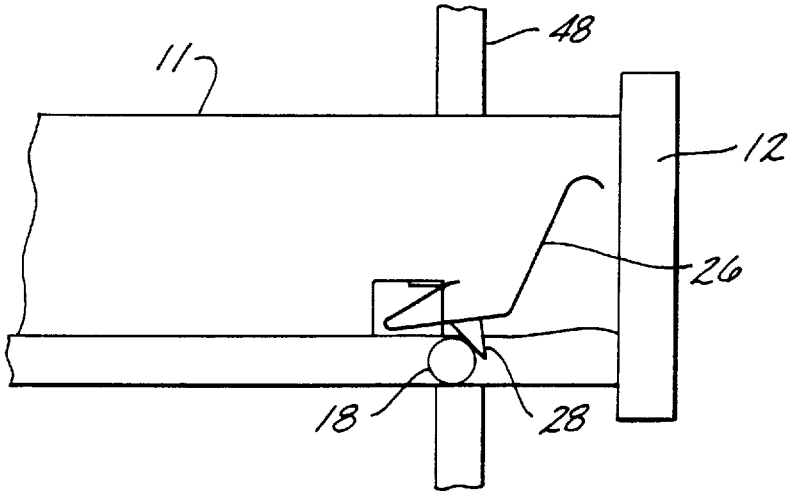

Referring to FIG. 7E, when drawer 11 is closed by pushing the drawer in a conventional manner, roller 18 engages angled edge of stop 28 and a continued closing action causes stop 28 to travel up and over roller 18 without any manual manipulation of lever arm 26. When drawer 11 is fully closed, child lock assembly 10 is reset to its original position as shown in FIG. 7A.

Figure 8:
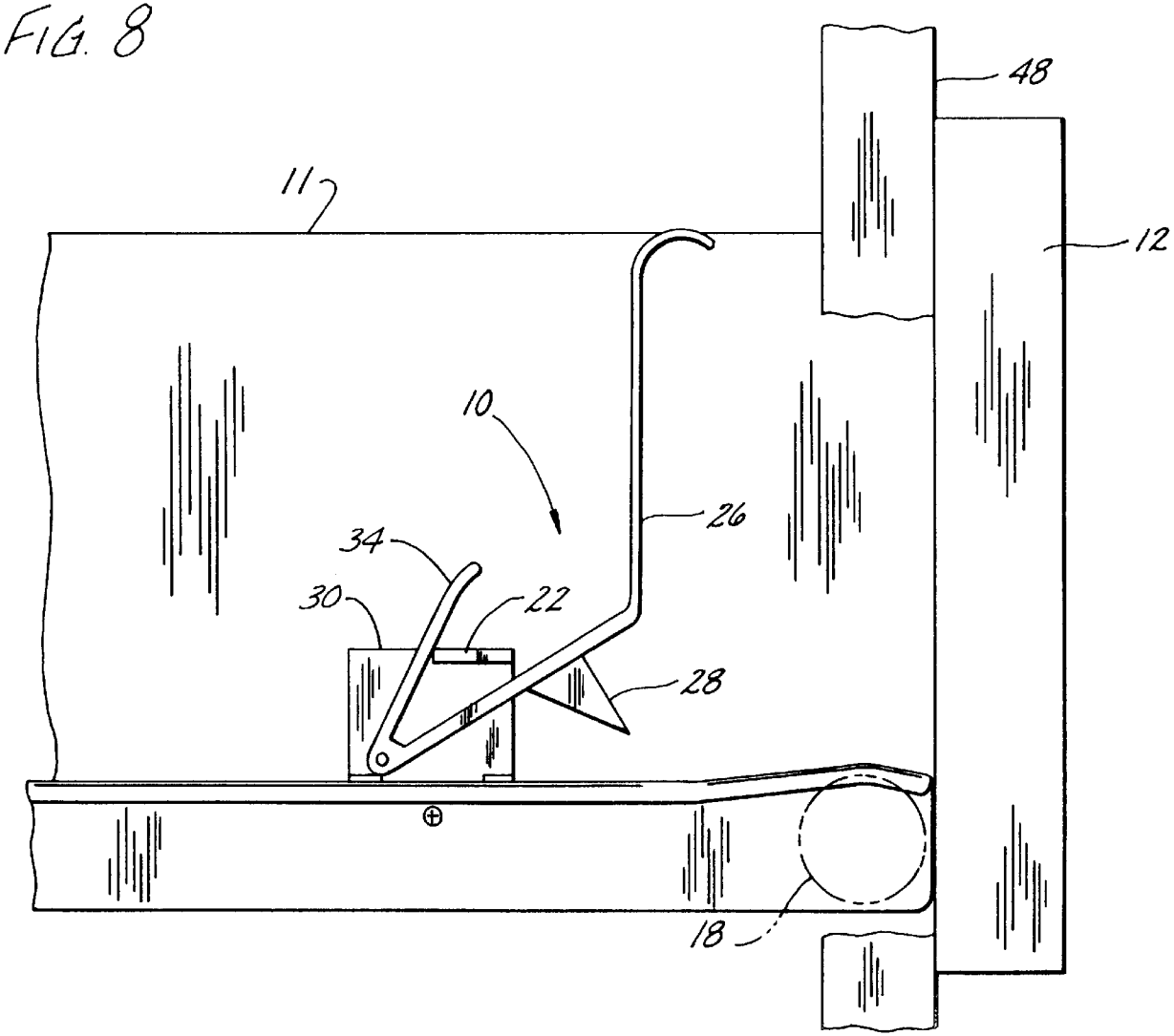
FIG. 8 illustrates the drawer slide child lock disengaged to allow for normal operation of the drawer.

Referring to FIG. 8, a preferred embodiment of the present invention also provides a means for disengaging the stop 28 to deactivate the operation of the drawer slide child lock assembly 10. The drawer slide lock assembly 10 can be disengaged by manually rotating tail 34 from front of mounting base flange 22 to the back of flange 22. The mounting base flange 22 mechanically holds tail 34 in a position such that lever arm 26 is raised and stop 28 is not in pathway of roller 18. Alternatively, the mounting base flange 22 may be magnetically connected to tail 34 to deactivate the child-proof lock assembly 10. Thus when drawer 11 is opened, forward progress of drawer 11 is not limited and drawer 11 can be opened and closed as normal.

Drawer slide child lock assembly 10 is designed preferably for use on drawer slides of the general type shown in FIG. 1 and preferably mounted to the captive side of the male drawer slide 16. It should be noted that the drawer slides may require modification to permit mounting and operation of drawer slide child lock assembly 10.

In another embodiment, the lock assembly 10 may be configured to operate with drawers that do not have drawer slides of the type shown in FIG. 1 (e.g., drawers having center drawer slides or no drawer slides at all). In this preferred embodiment, the mounting base 30 is attached to the exterior side of drawer 11 and the lever arm 26 rests against legs 36 of mounting base 30 to prevent downward rotation of the lever arm beyond the point where stop 28 projects below the bottom of the drawer 11. Preferably, the tail 34 compresses against, and is resiliently biased to, the front side of mounting base flange 22 so that the horizontal section 38 is forced to lie flat on the top sides of legs 36.

Preferably, the forward edge of stop 28 (i.e., the edge nearest the front of the drawer 11), engages the interior of the cabinet base 48 to prevent the drawer 11 from opening. In order to open the drawer using this preferred configuration, drawer front 12 is pulled away from cabinet base 48 in a conventional manner and opens until stop 28 engages the interior side of the cabinet base 48. To open the drawer 11 to its fully open position, lever arm 26 is raised such that stop 28 is lifted sufficiently to allow stop 28 to pass over cabinet base 48.

Preferably, in this embodiment, the rear edge of stop 28 is angled such that, upon closing the drawer 11, the rear edge of stop 28 travels up and over the cabinet base 48 without the need for any manipulation of lever arm 26.

Accordingly, the reader will see that the drawer slide child lock assembly referred to in this invention provides a low cost child-proof latch that may be included as part of the original drawer slide hardware. This built-in child lock option provides users with a convenient way to child-proof their cabinet drawers while preferably providing significant additional advantages. One can easily disengage the drawer slide child lock assembly for conventional, unprotected drawer operation. The drawer slide child lock assembly is preferably mounted on the side of a drawer and, thus, does not interfere with useable drawer space. It requires a very small opening to manipulate thereby limiting even partial access to drawer contents. It is largely hidden from view and less enticing to the curiosity of small children. In addition, it requires manipulation that is very difficult for a small child but very easy for an adult in order to open the drawer.

While the above description contains many specifics, these should not be construed as limitations on the scope of the invention, but rather as examples of one preferred embodiment thereof. Many variations to the described embodiment can be made without departing from the true spirit and scope of the invention. For example, the size and shape of lever arm 26 and stop 28 can vary. The pivot and spring action can be obtained through a variety of means including the use of a mechanical spring. Additionally, the location of the mounting base 30 can vary, for example base 30 may be attached directly to the male drawer slide 16. Therefore the appended claims should not be limited to the description of the preferred versions contained herein.

I claim:

1. A child-proof lock assembly of substantially rigid materials for a drawer disposed within a cabinet base, wherein the drawer has an external side and a male drawer slide having a flange on the external side, wherein the cabinet base has a female drawer slide mounted therein, the female drawer slide having a front end and a female guide channel for slideably receiving the male drawer slide to allow the drawer to guidably slide in and out of the cabinet base and a roller attached to the front end of the female drawer slide, the lock assembly comprising:

a latch mounted on the external side of the drawer, movable between a gravity disposed first position to prevent the drawer from opening and a second position to allow the drawer to be opened, the latch comprising:

an elongated lever arm pivotally mounted to the external side of the drawer and extending radially and upwardly toward the top and front of the drawer;

a restraining member projecting downwardly from the lever arm, the restraining edge having a forward edge facing the front of the drawer and a rear edge facing the back of the drawer;

a slot in the flange of the male drawer slide through which the restraining member may be received and project below the flange;

wherein the forward edge of the restraining member will engage the roller when the latch is disposed in the first position to prevent the drawer from opening; and wherein the lever arm may be raised upon application of upward pressure to move the latch into the second position to allow the drawer to be opened as the restraining member passes over the roller.

2. The child-proof lock assembly of claim 1 wherein the lever arm is biased in the first position.

3. The child-proof lock assembly of claim 1 further comprising means for disengaging the lock assembly.

4. The child-proof lock assembly of claim 1 wherein the restraining member can be disengaged by mechanically restraining the latch in the second position.

5. The child-proof lock assembly of claim 1 wherein the restraining member can be disengaged by magnetically restraining the latch in the second position.

6. The child-proof lock assembly of claim 1 wherein the rear edge of the restraining member is angled such that when the rear edge of the restraining member engages the roller upon closing the drawer, the lateral closing action causes the restraining member to travel up and over the roller without manipulation of the lever arm.

7. A child-proof lock assembly of substantially rigid materials for a drawer having an external side, wherein the drawer is disposed within a cabinet base, comprising:

a latch mounted on the external side of the drawer, the latch movable between a gravity disposed first position to prevent the drawer from opening and a second position to allow the drawer to be opened, the latch comprising:

an elongated lever arm pivotally mounted to the external side of the drawer side and extending radially and upwardly toward the top and front of the drawer;

a restraining member projecting downwardly from the lever arm, the restraining edge having a forward edge facing the front of the drawer and a rear edge facing the back of the drawer;

a mounting base attached to the external side of the drawer capable of engaging the lever arm to prevent downward rotation of the lever arm beyond the point where the restraining member projects below the bottom of the drawer;

wherein the forward edge of the restraining member will engage the interior of the cabinet base when the latch is disposed in the first position to prevent the drawer from opening; and wherein the lever arm may be raised upon application of upward pressure to move the latch into the second position to allow the drawer to be opened as the restraining member passes over the cabinet base.

8. The child-proof lock assembly of claim 7 wherein the lever arm is biased in the first position.

9. The child-proof lock assembly of claim 7 further comprising means for disengaging the lock assembly.

10. The child-proof lock assembly of claim 7 wherein the restraining member can be disengaged by mechanically restraining the latch in the second position.

11. The child-proof lock assembly of claim 7 wherein the restraining member can be disengaged by magnetically restraining the latch in the second position.

12. The child-proof lock assembly of claim 7 wherein the rear edge of the restraining member is angled such that when the rear edge of the restraining member engages the cabinet base upon closing the drawer, the closing action causes the restraining member to travel up and over the cabinet base without manipulation of the lever arm.

* * * * *